US005689796A

United States Patent [19]

Kasai et al.

[11] Patent Number: 5,689,796

[45] Date of Patent: Nov. 18, 1997

[54] METHOD OF MANUFACTURING MOLDED COPPER-CHROMIUM FAMILY METAL ALLOY ARTICLE

[75] Inventors: Takao Kasai, Tokyo; Naoto Ogasawara, Saitama; Naoyoshi Akiyoshi; Takeo Hamada, both of Osaka, all of Japan

[73] Assignees: Citizen Watch Co., Ltd., Tokyo; Toho Kinzoku Co., Ltd., Osaka, both of Japan

[21] Appl. No.: 687,003

[22] Filed: Jul. 18, 1996

[30] Foreign Application Priority Data

Jul. 18, 1995 [JP] Japan ..... 7-181206

[51] Int. Cl.[6] ..... B22F 3/12

[52] U.S. Cl. ..... 419/32; 419/33; 419/36; 419/37; 419/38; 419/47; 419/54; 419/58

[58] Field of Search ..... 419/32, 33, 36, 419/37, 38, 47, 54, 58

[56] References Cited

U.S. PATENT DOCUMENTS

| | | | |
|---|---|---|---|
| 3,890,145 | 6/1975 | Hivert et al. | 75/224 |
| 4,613,370 | 9/1986 | Held et al. | 75/248 |
| 4,681,733 | 7/1987 | Konishi | 419/8 |
| 4,710,223 | 12/1987 | Matejczyk | 75/248 |
| 4,784,690 | 11/1988 | Mullendore | 75/248 |
| 4,964,908 | 10/1990 | Greetham | 75/241 |
| 4,988,386 | 1/1991 | Oenning et al. | 75/247 |
| 5,125,962 | 6/1992 | Krentscher | 75/247 |
| 5,273,570 | 12/1993 | Sato et al. | 75/231 |
| 5,314,658 | 5/1994 | Meendering et al. | 419/33 |
| 5,498,276 | 3/1996 | Luk | 75/252 |

OTHER PUBLICATIONS

ASM Handbook, (ASMH), vol. 7, Powder Metallurgy, 1984, pp. 316–321.

*Primary Examiner*—Charles T. Jordan
*Assistant Examiner*—Daniel Jenkins
*Attorney, Agent, or Firm*—Flynn, Thiel, Boutell & Tanis, P.C.

[57] ABSTRACT

The method of the invention is concerned with the manufacture of a molded copper-chromium family metal based alloy article which involves the steps of injection-molding a mixture of copper powder, a chromium family metal powder, an iron family metal powder and a thermoplastic organic binder made up of a polymer binder and low molecular binder in a ratio by volume of 5:1 to 1:1, dewaxing a molded body formed by the injection-molding by heating in a reducing atmosphere, and then sintering the dewaxed molded body at 1,100° to 1,450° C. in a reducing atmosphere. According to this method, molded articles having a high dimensional accuracy and high density can be provided.

8 Claims, No Drawings

METHOD OF MANUFACTURING MOLDED COPPER-CHROMIUM FAMILY METAL ALLOY ARTICLE

BACKGROUND OF THE INVENTION

This invention relates to a method of manufacturing a part made of a Cu-W based or Cu-Mo based alloy or Cu-W/Mo based alloy used for an electrode material, an electrical contact material, a packaging material for a semiconductor, a heat sink or the like.

Heretofore, Cu-W based materials and Cu-Mo based materials have been widely used as materials for a discharge electrode, and recently, they have also been widely used as packaging materials for a semiconductor and members of a heat sink, due to their high thermal conductivity and adaption to the thermal expansion coefficient of semiconductor elements.

A conventional method of manufacturing Cu-W based or Cu-Mo based material is, as disclosed in Japanese Patent KOKOKU 5-38458, an infiltration process comprising press-molding W, Mo or W-Mo powder followed by sintering to prepare a porous skeleton, and impregnating molten Cu thereinto. A problem of the infiltration is in the difficulty of providing a uniform porosity in the skeletons which results in a difficulty in maintaining the copper content constant. Another problem with respect to the infiltration is the difficulty of preparing three dimensionally complex forms. Even in simple forms, they have inferior dimensional accuracy, and mechanical processing, which requires much work, is conducted in order to make a finished form.

Another conventional method disclosed in U.S. Pat. No. 4,011,291 comprises adding a thermoplastic binder to a sinterable powder and kneading to obtain a compound, injection-molding the compound into a prescribed form, debinding (dewaxing) the molded body in a turbulent atmosphere, and then sintering. According to this method, parts having a complex form may possibly be produced with good dimensional accuracy.

In U.S. Pat. No. 4,988,386, it is disclosed that a relative density of 97% was obtained with 5 to 50 wt. % Cu-W by powder injection molding. However, the products were not an alloy due to the insolubility between Cu-W but were a mixture instead of Cu and W. It is difficult to achieve a high density by sintering 2 kinds of metals without a solubility for each other, and in general, a metal having solubility. with both metals is added.

In Japanese Patent KOKAI, a method of obtaining a relative density of 98–99% is disclosed which comprises preparing a Cu-Ni-W alloy by powder injection molding and sintering at 1500°–1600° C. However, unsolved problems still remain in the application to the manufacture of a Cu-W or Cu-Mo based alloy by powder injection molding.

The first problem of the prior art is the low relative density or variation in relative densities of the manufactured alloys after sintering. The variation in relative densities results in a variation in contraction rates which to degrades dimensional accuracy. Accordingly, secondary processing is necessary for obtaining a finished form. When the sintering temperature is raised for the purpose of increasing the relative density, the evaporation of Cu is increased to change the Cu content as well as influencing the dimension of sintered bodies.

Among various powder injection molding methods, the thermal decomposition method is generally employed because of the simple apparatus and treatment required in the debinding process. The second problem is in the retention of the form of high density materials, such as Cu-W or Cu-Mo based alloys, in the dewaxing process. Unless care for maintaining the forms is taken, the injection molded bodies deform which results in the failure to obtain bodies having the desired form.

The third problem is in the variation in molding flow rate of a compound prepared by mixing and kneading a raw material powder with a binder. The variation changes the quantity of the compound charged into a mold through injection molding, and the size of the injection-molded body varies. When a compound with an extremely poor fluidity is used, uncharged portions remain in the molded bodies. The variation in size of the molded bodies directly influences the variation in size of the sintered bodies.

As a selection criteria for raw material powders for conserving the fluidity of a compound, mean particle size and particle size distribution measured by a particle size measuring apparatus such as the laser interference type, specific surface area by a surface area measuring apparatus and tap density were used. However, since particle forms of the material powder industrially available are not only ideal spheres but are mixed with irregular particles and agglomerates, the above references are insufficient for conserving the fluidity of a compound for powder injection molding.

The fourth problem is in the mixing process of the alloy powder. Heretofore, an organic solvent such as an alcohol was added to a powder mixture, and pulverized by a ball mixer or an attritor for a long period of time. This process not only requires a lot of time but also does not achieve homogeneous mixing due to the oxidation causes by moisture formation during the drying the organic solvent or the plastic deformation of soft metal particles, such as Cu, Co and Fe, mixed with W into flattened forms.

SUMMARY OF THE INVENTION

An object of the invention is to provide a method of manufacturing a molded copper-chromium family metal based alloy article having a high dimensional accuracy and a high density by powder injection molding.

The present invention provides a method of manufacturing a molded copper-chromium family metal based alloy article which comprises injection-molding a mixture consisting essentially of copper powder, a chromium family metal powder, an iron family metal powder and a thermoplastic organic binder consisting essentially of a polymer binder and low molecular binder in a ratio by volume of 5:1 to 1:1, dewaxing the molded body formed by the injection-molding by heating in reducing atmosphere, and then sintering the dewaxed molded body at 1,100° to 1,450° C. in a reducing atmosphere.

DETAILED DESCRIPTION OF THE INVENTION

A mean particle size of Cu powder exceeding 20 μm is undesirable because of the formation of voids in a sintered body to decrease the sintered density, dimensional accuracy and various properties such as thermal conductivity. A preferable upper limit of the mean particle size is 10 μm, particularly preferably 2 μm. On the other hand, a preferable lower limit is about 0.5 μm, particularly preferably about 1.0 μm. As the particle form, spheres, crushed forms, flakes and so on, according to the manufacturing process, can be used. A preferable form is a sphere for sintered density and dimensional accuracy.

As the chromium family metal powder, W powder and Mo powder are preferable. In considering only sintering facilitation, as to the particle size of the chromium family metal powder, more fine particles should be selected. However, during manufacturing using powder injection molding, when the amount of fine particles becomes high, the binder quantity necessary for obtaining a prescribed fluidity increases. The increase of the binder quantity is undesirable because it induces deformation during the dewaxing process. On the other hand, the use of coarse particles of W powder or Mo powder is undesirable because they raise the sintering temperature and increase the evaporation quantity of Cu during sintering. Accordingly, a preferable mean particle size of the chromium family metal powder is about 0.5 to 3.0 μm, more preferably 0.8 to 2.5 μm, most preferably 1.0 to 2.0 μm.

An iron family metal powder is used as a sintering aid, and may be any one of nickel, iron, cobalt or a combination of two or more of them. A suitable particle size is 20 μm or less as a mean particle size for the same reason as with the Cu powder. A preferable upper limit of the mean particle size is 10 μm, particularly preferably 2 μm. On the other hand, a preferable lower limit is about 0.5 μm, particularly preferably about 1.0 μm. As the particle form, there are spheres, crushed forms, flakes and so on, according to the manufacturing process, and spheres are preferable.

It is preferable to add phosphorus to the alloy of the invention. The phosphorus is a sintering aid and remains in the alloy after sintering. The phosphorus is added preferably in a form of a phosphide of one of the above metals, e.g. copper phosphide, tungsten phosphide, molybdenum phosphide, nickel phosphide, iron phosphide and cobalt phosphide. Preferable phosphides are copper phosphide, nickel phosphide and cobalt phosphide. The phosphorus also can be added in the form of a phosphate and copper phosphate is preferable. A suitable particle size of the phosphorus, such as a phosphide, is 20 μm or less as a mean particle size for the same reasons as for the Cu powder. A preferable upper limit of the mean particle size is 10 μm, particularly preferably 2 μm. On the other hand, a preferable lower limit is about 0.5 μm, particularly preferably about 1.0 μm. As the particle form, there are spheres, crushed forms, flakes and so on, according to the manufacturing process, and spheres are preferable.

As to the blending ratio, the ratio of the copper powder and chromium family metal powder is set by the thermal expansion coefficient, heat conductivity, etc. required for a molded article to be manufactured. In general, a suitable ratio of Cu: chromium family metal is in the range of 5:95 to 50:50, preferably 8:92 to 35:65, more preferably 10:90 to 25:75, by weight. Since the iron family metal powder which is a sintering aid decreases the alloy's thermal conductivity, a lower blending amount is more preferable. However, when the blending amount is less than 0.1 wt. %, the sintering acceleration effect is insufficient. The upper limit depends on the thermal expansion coefficient and heat conductivity required for each molded article to be manufactured. A preferable blending amount is in the range of about 0.2 to 0.5 wt. %. By blending phosphorus, the sintering temperature can be lowered, and sintered density and heat conductivity are improved. A suitable amount of phosphorus is about 0.002 to 0.4 wt. %, preferably about 0.01 to 0.1 wt. % as the phosphorus content after sintering.

As the blending amount, for example, in the case of copper phosphide ($Cu_3P$), a suitable amount is 0.2 to 6 wt. % (0.03 to 1.2 as P %).

It is prefereable that, after preliminarily mixing each weighed component powder, as with a mixing and grinding machine, the preliminary mixture is pulverized by a dry grinding machine, such as a jet mill, in an the atmosphere or in inactive atmosphere, such as nitrogen or argon gas, as to hard materials for the purpose of crushing agglomerated particles, and as to soft materials, for the purpose of spheroidizing irregular particles. By the above treatment, oil absorption of the powder mixture can be adjusted to a prescribed value by crushing agglomerates and arranging the particle form. The inventors found that the oil absorption of a powder has a correlation with the injection fluidity of a compound for injection molding over a wide range and that the stabilization of compound fluidity improves the dimensional accuracy of an object finished part. Accordingly, it is preferable to adjust the variation in of oil absorption of the powder mixture to within about ±0.1 ml/cm$^3$.

The oil absorption can be measured by the following method. That is, an almost constant weight powder is weighed, and put on a glass plate. Linseed oil is filled in a buret measurable up onto 0.1 ml, and is dropped to the powder drop by drop, and kneaded well by an iron spatula. When the agglutinated powder is suddenly softened by adding one further drop, the oil drops are stopped. The added total amount of oil before the sudden softening is measured, and the oil absorption is calculated by the following formula:

$$A=(V/S)\times d$$

A: Oil absorption (ml/cm$^3$)

V: Oil amount added before softening (ml)

S: Weight of powder (g)

d: Density of powder (g/cm$^3$)

A preferable oil absorption depends on the viscosity and blending amount of binder and injection molding conditions.

A compound to be used for injection molding is prepared by adding the thermoplastic organic binder to the above powder mixture and kneading them. The thermoplastic organic binder consists essentially of a polymer binder and a low molecular binder.

The polymer binder has a molecular weight of about 10,000 or more and has a higher melting point, a higher resistance to deformation at high temperature and a higher thermal decomposition temperature than the low molecular binder. Illustrative of the polymer binders are copolymers of ethylene vinyl acetate (EVA)-butyl methacrylate (BMA)-styrene, and polypropylene (PP), polyethylene (PE) and combinations thereof.

The low molecular binder has a molecular weight of no more than about 5,000 and is melted to remove it from a molded body or evaporated at a temperature lower than the temperature of softening of the polymer binder to resist to deformation. Illustrative of the low molecular binders are polyethylene wax, paraffin wax, microcrystalline wax, carnauba wax, stearic acid, dibutyl phthalate (DBP), oleic acid, and combinations thereof.

All binder components of the thermoplastic organic binder are evaporated or decomposed at a temperature of 500° C. or less in a reducing atmosphere having a dew point of −50° C. or less, and leave less than 0.1 wt. % residues.

The ratio of the polymer binder: the low molecular binder is 5:1 to 1:1, preferably 3:1 to 1:1, in order to avoid deformation of a molded body composed of a high density material, such as Cu-W or Cu-Mo based alloy powder mixture, in a dewaxing process. When the ratio of the low molecular binder is higher than the above, the molded body deforms in the dewaxing process to degrade the dimensional accuracy. On the other hand, when the ratio of the polymer binder is higher than the above, the fluidity of the compound is degraded to decrease the charging ability into an injection molding mold resulting in the degradation of dimensional accuracy. A preferable blending amount of the thermoplastic organic binder is about 30 to 60 vol. %, preferably about 35 to 55 vol. %, particularly preferably about 40 to 50 vol. % with respect to the raw material powder. A blending amount lower than the above degrades the injection moldability and on the other hand, a blending amount higher than the above increases the deformation upon dewaxing and extends dewaxing time. By using the thermoplastic organic binder, compounds obtained are excellent in injection moldability, dewaxing efficiency, form retention in dewaxing, avoidance of carbide residues.

Kneading may be conducted using a known pressure kneader, and a preferable kneading temperature is about 120° to 160° C.

The compound obtained by the kneading, which is optionally granulated, in and molded into a desired form by an injection molding machine, and then, dewaxing is conducted.

In the case of the copper-chromium family metal alloy of the invention, since the density of the sintered body is greatly lowered by light oxidation, hydrogen gas or a gas mixture of hydrogen gas and an inactive gas such as nitrogen gas or argon gas is used as the dewaxing atmosphere. In the case of the gas mixture, it is preferable to incorporate, at least, 10 vol. % of hydrogen gas. A suitable dew point of the atmospheric gas is −40° C. or less, and −50° C. or less is preferred. With respect to the dewaxing temperature, the density of the copper-chromium family metal alloy of the invention is greatly lowered by carburization around 800° C. or more, and accordingly, it is desirable to remove the binder components and their residual carbides from the molded body to a content of no more than 0.1%, preferably no more 0.05% before reaching the carburization initiating temperature. The removal is preferably completed at a temperature of no more than 700° C., more preferably no more than 600° C., particularly preferably no more than 500°C. In general, by elevating the temperature from room temperature to 500° C. at a rate of 3°–5° C./hour in the above atmosphere, the carbon content of the molded body becomes no more than 0.01%, when dewaxing is finished. The heating vate varies according to the thickness of the dewaxed body, etc.

The dewaxed body is subsequently subjected to sintering in a reducing atmosphere using hydrogen gas or a gas mixture of hydrogen gas and an inert gas such as nitrogen gas and or argon gas. In the case of the gas mixture, it is preferable to incorporate, at least, 50 vol. % of hydrogen gas. A suitable dew point of the atmospheric gas is no higher than −40° C., preferably no higher than −50° C. A hydrogen gas atmosphere is preferred. Sintering is conducted at 1,100 to 1,450° C. To obtain a sintered body having its true density is difficult lower than 1,100° C. When the sintering temperature is higher than 1,450° C., the evaporation of copper is remarkable, and it is difficult to obtain a sintered body having a desired composition. A preferable sintering temperature is about 1,150°to 1,300° C. Sintering is fininshed, in general, in a period of about 1 to 3 hours to obtain a high density article having its almost true density, i.e. a relative density of 99% or more, usually 99.5% or more.

According to the method of the invention, in the manufacture of molded articles made of copper-chromium family metal alloys utilizing injection molding, molded articles having a high dimensioned accuracy and high physical properties, even with a complex form, can be manufactured stably and inexpensively.

EXAMPLES

Example 1

W powder having a mean particle size of 2.0 μm and electrolysis process Cu powder having a particle size of no more than 8 μm were weighed to prepare a 10 wt. % Cu-W powder mixture. 0.225 part by weight of carbonyl process Co powder having a mean particle size of 1.5 μm and 0.35 part by weight of no more than $Cu_3P$ having a particle size of 10 μm were weighed, and preliminary mixed with 100 parts by weight of the above Cu-W powder mixture. Subsequently, the preliminary mixture was put in a jet mill, and the crushing of agglomerates and arranging of particle form were conducted at a nozzle pressure of 7 kg/m$^2$ and gas (inert gas) volume of 1.2 m$^3$/min to obtain a treated powder having an oil absorption of 0.8 ml/cm$^3$. The oil absorption of the preliminary mixture before being inserted into the jet mill was 1.7 ml/cm$^3$.

To the metal powder mixture thus prepared, a thermoplastic organic binder was added, and kneaded by a pressure kneader for 3 hours, followed by granulating to prepare a compound for injection molding. The blended amount of the binder was 5.3 parts by weight per 100 parts by weight of the metal powder (binder=47 vol %). The fluidity of the compound measured by a flow tester was 0.90 ml/sec at 145° C. which was consistent with the object desired value. The composition of the binder is shown in Table 1.

TABLE 1

| Binder | Content (wt. %) |
|---|---|
| Polymer Binder | |
| PS | 22.0 |
| EVA | 11.0 |
| BMA | 22.0 |
| Low Molecular Binder | |
| Paraffin Wax | 35.0 |
| DBP | 5.0 |
| Stearic Acid | 5.0 |

Subsequently, using an injection molding machine having a mold clamping pressure of 25 t, molding was conducted at a mold temperature of 25° C. and a cylinder temperature of 145° C. to produce molded bodies having a size of 25 mm×25 mm×2 mm.

The molded bodies were dewaxed in a hydrogen gas atmosphere having a dew point of −60° C. by elevating temperature from room temperature to 500° C. at a rate of 5° C./hour. The carbon content of the dewaxed bodies was 0.019 wt. %.

Thereafter, the dewaxed bodies were sintered in a hydrogen gas atmosphere having a dew point of −60° C. at 1,250° C. for 1 hour.

The sintered bodies had a sintered density of 17.23 (relative density:99.9%) and a heat conductivity of 159 W/m-K. Size variation was within ±0.2% of a set value and milling, which had been conducted in conventional processes for making a finished form, could be omitted.

Example 2

Using Mo powder having a mean particle size of 1.8 μm instead of W powder, sintered bodies were produced in a manner similar to Example 1. The sintered bodies had almost the same relative density as Example 1, and the size variation was also very small, and milling also could be ommited.

We claim:

1. A method of manufacturing a molded copper-chromium family metal based alloy article which comprises injection-molding a mixture consisting essentially of copper powder, a chromium family metal powder, an iron family metal powder, phosphorous and a thermoplastic organic binder consisting essentially of a polymer binder and a low molecular binder in a ratio by volume of 5:1 to 1:1, dewaxing a molded body formed by the injection-molding by heating in a reducing atmosphere, and then sintering the dewaxed molded body at 1,100 to 1,450° C. in a reducing atmosphere.

2. The method of claim 1 wherein the chromium family metal is tungsten or molybdenum.

3. The method of claim 1 wherein said phosphorus is present as a compound selected from the group consisting of copper phosphide, nickel phosphide, cobalt phosphide and copper phosphate.

4. The method of claim 1 wherein said mixture is pulverized by a jet mill.

5. The method of claim 1, wherein said polymer binder is selected from the group consisting of copolymers of ethylene vinyl acetate-butyl methacrylate-styrene, polypropylene, polyethylene and mixtures thereof and said low molecular binder is selected from the group consisting of polyethylene wax, paraffin wax, microcrystalline wax, carnauba wax, stearic acid, dibutyl phthalate, oleic acid and mixtures thereof.

6. The method of claim 1, wherein the ratio of polymer binder to low molecular binder is from 3:1 to 1:1.

7. The method of claim 1, wherein the copper powder has a mean particle size of from 1–2 μm, the chromium family metal powder has a mean particle size of from 1–2 μm and the iron family powder has a mean particle size of from 1–2 μm.

8. The method of claim 1, wherein the ratio of copper powder to chromium family metal powder is 10:90–25:75, by weight, the iron family metal powder is present in an amount of from 0.2 to 0.5 wt. % and the phosphorus is present in an amount of from 0.01–0.1 wt. %.

* * * * *